US007323285B2

(12) United States Patent
Foster et al.

(10) Patent No.: US 7,323,285 B2
(45) Date of Patent: Jan. 29, 2008

(54) EXTRUDED SLIPPING LAYER FOR THERMAL DONOR

(75) Inventors: David G. Foster, West Henrietta, NY (US); Narasimharao Dontula, Rochester, NY (US); Maurice L. Gray, Rochester, NY (US); William H. Simpson, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 157 days.

(21) Appl. No.: 11/274,463

(22) Filed: Nov. 15, 2005

(65) Prior Publication Data

US 2007/0111133 A1 May 17, 2007

(51) Int. Cl.

| | |
|---|---|
| ***G03C 8/00*** | (2006.01) |
| ***G03C 1/492*** | (2006.01) |
| ***G03C 1/494*** | (2006.01) |
| ***B41M 5/00*** | (2006.01) |
| ***B05D 1/02*** | (2006.01) |

(52) U.S. Cl. ..... 430/199; 430/200; 430/201; 430/271.1; 430/935; 430/964; 503/201; 503/227; 427/421.1; 428/32.6; 428/32.8; 428/409; 428/913

(58) Field of Classification Search ..... 430/200, 430/201, 271.1, 935, 964, 199; 503/201, 503/227; 427/421.1; 428/32.6, 32.8, 409, 428/913

See application file for complete search history.

(56) References Cited

U.S. PATENT DOCUMENTS

| | | | | |
|---|---|---|---|---|
| 4,702,874 | A * | 10/1987 | Ohara et al. | 264/173.19 |
| 4,782,041 | A | 11/1988 | Vanier | |
| 4,892,860 | A | 1/1990 | Vanier | |
| 5,069,962 | A | 12/1991 | Okazaki et al. | |
| 5,234,889 | A | 8/1993 | DePalma et al. | |
| 5,236,768 | A | 8/1993 | Fujji et al. | |
| 5,252,534 | A | 10/1993 | DePalma et al. | |
| 5,558,972 | A * | 9/1996 | Van Damme et al. | 430/200 |
| 5,589,317 | A * | 12/1996 | Defieuw et al. | 430/203 |
| 5,627,130 | A | 5/1997 | Bailey et al. | |
| 5,763,358 | A * | 6/1998 | Kaszczuk et al. | 503/227 |
| 6,599,383 | B1 | 7/2003 | Wood, Jr. et al. | |
| 6,825,150 | B2 * | 11/2004 | Smith et al. | 503/227 |
| 6,939,828 | B2 * | 9/2005 | Arrington et al. | 503/227 |

FOREIGN PATENT DOCUMENTS

| | | |
|---|---|---|
| EP | 546 675 | 1/1998 |
| JP | 10-296933 | 11/1998 |

* cited by examiner

*Primary Examiner*—Geraldina Visconti
(74) *Attorney, Agent, or Firm*—Kathleen Neuner Manne; Lynne M. Blank

(57) ABSTRACT

A thermal donor element having a dye layer on an extruded substrate, wherein the extruded substrate includes a polyester-containing material and a slip agent, but does not contain silica particles, is disclosed.

20 Claims, No Drawings

EXTRUDED SLIPPING LAYER FOR THERMAL DONOR

FIELD OF THE INVENTION

A thermal donor element including a dye layer on an extruded substrate is disclosed, wherein the substrate includes a polyester-containing material and a slip agent, but does not contain silica particles.

BACKGROUND OF THE INVENTION

Thermal transfer systems have been developed to obtain prints from pictures that have been generated electronically, for example, from a color video camera or digital camera. An electronic picture can be subjected to color separation by color filters. The respective color-separated images can be converted into electrical signals. These signals can be operated on to produce electrical signals corresponding to various colors, for example, black, cyan, magenta, or yellow. These signals can be transmitted to a thermal printer. To obtain a print, a colored dye-donor layer, for example, black, cyan, magenta, or yellow, of a dye-donor element can be placed face-to-face with a dye image-receiving layer of a receiver element to form a print assembly, which can be inserted between a thermal print head and a platen roller. A thermal print head can be used to apply heat from the back of the dye-donor element. The thermal print head can be heated up sequentially in response to the various color signals. The process can be repeated as needed to print all colors, and a laminate or protective layer, as desired. A color hard copy corresponding to the original picture can be obtained. Further details of this process and an apparatus for carrying it out are described in U.S. Pat. No. 4,621,271 to Brownstein.

Thermal transfer works by transmitting heat through the dye-donor element from the back-side to the dye-donor layer. When the dyes in the dye-donor layer are heated sufficiently, they sublime or diffuse, transferring to the adjacent dye-receiving layer of the receiver element. The density of the dye forming the image on the receiver can be affected by the amount of dye transferred, which in turn is affected by the amount of dye in the dye-donor layer, the heat the dye-donor layer attains, and the length of time for which the heat is maintained at any given spot on the dye-donor element.

Current dye donor elements generally have numerous layers coated on each side of the support to enable good quality prints with desired characteristics and performance. It is advantageous to reduce the number of layers for both cost and performance because each layer in a dye-donor element can act as an insulator, slowing down the heat transfer through the layers of the dye-donor element to the receiver. At high printing speeds, and the resulting short application time, any reduction in heat transfer efficiency results in a lower effective temperature in the dye-donor layer during printing, which will result in a lower transferred dye density. One way to overcome the low print density associated with shorter line times is to reduce the thickness of the dye-donor layer, thus making the heat transfer efficiency greater.

Various other methods can also be employed to increase the heat transfer efficiency of the dye-donor element. Two such methods are increasing the print head voltage or increasing the relative amount of dye load. Both of these methods result in increased cost and other performance problems such as unwanted dye transfer and reduced print head lifetimes.

Thermal donors can be manufactured using various methods Typically, a substrate is formed by casting, and the dye layer is coated on the substrate by any known means, for example, gravure coating, spray coating, blade coating, or printing, such as ink jet printing. Substrates used for thermal donors are typically not extruded.

Various extruded films are known for other uses. For example, U.S. Pat. No. 6,599,383 B1 discloses a film comprising a first extruded layer including silicone oil, and a second extruded layer, wherein the first extruded layer has a lower coefficient of friction than the second extruded layer. Both layers include particles, preferably silica particles. U.S. Pat. No. 5,069,962 describes a biaxially oriented laminated film for magnetic recording material including a first layer containing a first thermoplastic resin as a major constituent, and a second layer containing a second thermoplastic resin comprising a crystalline polyester with inert particles. U.S. Pat. No. 5,236,768 discloses a heat resistant lubricating layer containing a modified silicone oil with a viscosity not lower than 600 cSt for use on the opposite side of the substrate from the dye layer of a thermal donor.

Typically slipping agents that have been used in extrusion for non-thermal imaging applications are fluoropolymer powders, for example, micronized polytetrafluoroethylene (PTFE), graphite, fatty acid esters, pentaerythritol, montanic acid esters, and sodium montanate. Silicones in the form of ultrahigh molecular weight siloxanes have also been used as lubricants.

A continuing problem of extruded films in the prior art is that they are insufficient to be used in thermal transfer because they stick to the print head during the printing process. It is desirable to have a film that has the dimensional stability of current base film supports while also incorporating slip agents to facilitate transport through the printer without annealing the film to the print head, thereby preventing stoppage of the process due to transport failure.

SUMMARY OF THE INVENTION

A thermal donor element and a method of making the same are described, wherein the thermal donor element has an extruded substrate having a polyester-containing material and a slip agent, and a dye layer on the substrate, wherein the extruded substrate does not contain silica particles.

Advantages

The use of a dye-donor element comprising an extruded substrate enables more efficient thermal transfer by removing layers of the film structure. It reduces cost by combining the layers that function as the base film and the slip or heat-resistant layer that maintains good dye-donor layer keeping properties. The extruded substrate increases dye transfer efficiency and performance equivalent to slip and heat-resistant layers, preventing sticking of the dye-donor material to the print head during the printing process. The substrate has the necessary dimensional stability for use as a thermal donor while also providing necessary lubrication to facilitate transport of the donor through the printing mechanism.

DETAILED DESCRIPTION OF THE INVENTION

A thermal donor element having a dye layer on an extruded substrate is described, wherein the substrate includes a polyester-containing material and a slip agent, but has no silica particles.

The substrate of the dye-donor element can include one or more polymers that are dimensionally stable and can withstand the heat of a thermal print head. Such polymers can include, but are not limited to, polyesters; polyamides; polycarbonates; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene, or methyl pentene polymers; polyimides such as polyimide amides and polyetherimides; copolymers of the above; and mixtures thereof.

According to certain embodiments, the substrate can include a polyester. Polyesters suitable for use are those derived from the condensation of aromatic, cycloaliphatic, and aliphatic diols with aliphatic, aromatic, and cycloaliphatic dicarboxylic acids. Suitable polyesters can include cycloaliphatic, aliphatic, and aromatic polyesters. Exemplary polyesters can include, but are not limited to, poly(ethylene terephthalate), poly(cyclohexenedimethylene) terephthalate, poly(ethylene dodecate), poly(butylene terephthalate), poly(ethylene naphthalate), poly(ethylene(2,7-naphthalate)), poly(methaphenylene isophthalate), poly (glycolic acid), poly(ethylene succinate), poly(ethylene adipate), poly(ethylene sebacate), poly(decamethylene azelate), poly(ethylene sebacate), poly(decamethylene adipate), poly (decamethylene sebacate), poly(dimethylpropiolactone), poly(para-hydroxybenzoate), poly(ethylene oxybenzoate), poly(ethylene isophthalate), poly(tetramethylene terephthalate, poly(hexamethylene terephthalate), poly(decamethylene terephthalate), poly(1,4-cyclohexane dimethylene terephthalate)(trans), poly(ethylene 1,5-naphthalate), poly (ethylene 2,6-naphthalate), poly(1,4-cyclohexylene dimethylene terephthalate)(cis), and poly(1,4-cyclohexylene dimethylene terephthalate(trans). Another suitable polyester is polylactic acid (PLA). Suitable polylactic acids can be prepared by polymerization of lactic acid or lactide, and include at least 50% by weight of lactic acid residue repeating units, lactide residue repeating units, or combinations thereof. Polylactic acid can be a homopolymer or a copolymer, for example, a random or block copolymer of lactic acid, lactide, or a combination thereof.

According to certain embodiments, the substrate can include poly(ethylene terephthalate), poly(ethylene naphthalate), polylactic acid, or combinations thereof, because of their melt processability, strength, and flexibility. The substrate can have a thickness of from 1 μm to 30 μm, for example, from 1.0 μm to 7.0 μm. The substrate can be a single layer, or two or more co-extruded layers.

Slip agents suitable for use in the substrate can be thermally stable, have low volatility, and have low chemical reactivity. Exemplary slip agents include silicone resins such as ultra high molecular weight siloxanes and high molecular weight copolymers of siloxanes. Examples of suitable commercially available silicone resins include, for example, MB50™ silicones from Dow Coming, Midland, Mich., and Tospearl™ from GE Silicones, Wilton, Conn. Use of high molecular weight silicone resins overcomes the problems of volatilization, caused by using silicone liquids or lower molecular weight forms of silicone in extrusion. High molecular weight siloxanes suitable for use herein have a viscosity of 1 million cSt or greater. The slip agent can also include a mixture of silicone resin and wax, for example, a polyolefin wax, a low molecular weight olefin/maleic polymer, a low molecular weight polyalphaolefin, a polypropylene wax, or a low molecular weight ethylene homopolymer. Suitable waxes can have a molecular weight less than 10,000, and can be of very low viscosity, for example, less than 1000 cSt, or 100 cSt or less. Exemplary ethylene homopolymer waxes can be linear or saturated, and can have a molecular weight distribution less than or equal to 2. Exemplary polyalphaolefins can be highly polydispersed and can have a molecular weight distribution of 2 to 18. Suitable waxes include, but are not limited to, the following: Unilin™, Ceramer™, Vybar™, and Polywax™ from Baker Petrolite, Sugar Land, Tex.; A-C grade from Honeywell Specialty Waxes and Additives, Morristown, N.J.; Epolene grade from Eastman Chemical Company, Kingsport, Tenn.; and MPP™, MP™, and PROPYLTEX™ grades from Micro Powders Inc., Tarrytown, N.Y. One or more slip agent can be used in an amount of from 0.05 wt % to 10 wt %, for example, from 0.5 wt % to 5 wt %. When silicone resin is used as one of the slip agents with a low molecular weight wax, the ratio of silicone slip agent to wax is from 1:10 to 10:1. A mixture of two or more waxes can also be used as the slip agent.

The slip agents can be incorporated into the substrate polymer. The slip agents can be blended with the polymer and then fed into an extruder or compounder. According to certain embodiments, the slip agent and polymer can be mixed in a twin screw extruder. A master batch of the slip agent can be made, wherein a master batch is a slip agent-containing material having a polymer containing a higher concentration of slip agent than the final concentration of slip agent used in the substrate.

The slip agent, or a master batch containing the slip agent, can be combined with the remaining components of the substrate, such as the polymer, and extruded as a single layer. Alternately, a master batch can be let down as needed and co-extruded with the substrate material to form a co-extruded substrate of two or more layers, wherein the slip agent is in at least the layer on the opposite side of the substrate from the dye-donor material, and can be in the layer adjacent the thermal print head on printing. When co-extruded, the layer containing the slip agent can have a thickness of 0.05 μm to 1.0 μm, for example, from 0.7 to 1.0 μm.

Numerous techniques are known in the art and can be used for extruding or co-extruding cast polymer sheets forming the polymeric substrate of the invention. Typical co-extrusion technology is taught in W. J. Schrenk and T. Alfrey, Jr., "Coextruded Multilayer Polymer Films and Sheets," Chapter 15, Polymer Blends, p. 129-165, 1978, Academic Press; and D. Djorjevic, "Coextrusion," Vol. 6, No. 2, 1992, Rapra Review Reports. As used herein, "extrusion" and like terms include co-extrusion unless otherwise indicated. According to various embodiments, the cast sheet can be subsequently oriented by stretching, at least in one direction. Methods of uniaxially or biaxially orienting a sheet after it is cast on a chill roll are well known in the art. Such methods can include stretching or orienting the sheet at least in the machine or longitudinal direction by an amount of 1.5 to 6 times its original dimension. The sheet can be stretched in the transverse or cross-machine direction by an amount of from 1.5 to 8 times the original dimension. Stretching orients the extruded polymer and achieves desired levels of thickness uniformity and mechanical performance. Such apparatus and methods are well known in the art and are described, for example, in U.S. Pat. No. 3,903,234. The oriented sheet can be subjected to a heat-setting step after a transverse direction stretch to improve dimensional stability and mechanical performance.

Particles, such as mircobeads, can be added to the substrate or slip layer as desired. Such particles must be capable of withstanding the heat of extrusion. The use of silica particles is not recommended.

The dye-donor element can include a dye-donor layer. The dye-donor layer can include one or more colored areas (patches) containing one or more dye suitable for thermal printing. As used herein, a "dye" can be one or more dye, pigment, colorant, or a combination thereof. "Thermal printing" refers to sublimation and diffusion printing processes, for example, resistive head and laser thermal printing. During thermal printing, at least a portion of at least one colored area of the dye-donor layer of the dye-donor element can be imagewise or patch transferred to the receiver element, forming a colored image on the receiver element. The dye-donor layer can include one or more colored areas, a laminate area (patch) having no dye, or a combination thereof. The laminate area can follow one or more colored areas. During thermal printing, the entire laminate area can be transferred to the receiver element. The dye-donor layer can include one or more colored areas and one or more laminate areas. For example, the dye-donor layer can include three-color patches, for example, yellow, magenta, and cyan, and a clear laminate patch, for forming a full color image with a protective laminate layer on a receiver element.

Any dye transferable by heat can be used in the dye-donor layer of the dye-donor element. The dye can be selected by taking into consideration hue, lightfastness, and solubility of the dye in the dye-donor layer binder and the dye image receiving layer binder. Examples of suitable dyes can include, but are not limited to, diarylmethane dyes; triarylmethane dyes; thiazole dyes, such as 5-arylisothiazole azo dyes; methine dyes such as merocyanine dyes, for example, aminopyrazolone merocyanine dyes; azomethine dyes such as indoaniline, acetophenoneazomethine, pyrazoloazomethine, imidazoleazomethine, imidazoazomethine, pyridoneazomethine, and tricyanopropene azomethine dyes; xanthene dyes; oxazine dyes; cyanomethylene dyes such as dicyanostyrene and tricyanostyrene dyes; thiazine dyes; azine dyes; acridine dyes; azo dyes such as benzeneazo, pyridoneazo, thiopheneazo, isothiazoleazo, pyrroleazo, pyraleazo, imidazoleazo, thiadiazoleazo, triazoleazo, and disazo dyes; arylidene dyes such as alpha-cyano arylidene pyrazolone and aminopyrazolone arylidene dyes; spiropyran dyes; indolinospiropyran dyes; fluoran dyes; rhodaminelactam dyes; naphthoquinone dyes, such as 2-carbamoyl-4-[N-(p-substituted aminoaryl)imino]-1,4-naphthaquinone; anthraquinone dyes; and quinophthalone dyes. Specific examples of dyes usable herein can include:

C.I. (color index) Disperse Yellow 51, 3, 54, 79, 60, 23, 7, and 141;

C.I. Disperse Blue 24, 56, 14, 301, 334, 165, 19, 72, 87, 287, 154, 26, and 354;

C.I. Disperse Red 135, 146, 59, 1, 73, 60, and 167;

C.I. Disperse Orange 149;

C.I. Disperse Violet 4, 13, 26, 36, 56, and 31;

C.I. Disperse Yellow 56, 14, 16, 29, 201 and 231;

C.I. Solvent Blue 70, 35, 63, 36, 50, 49, 111, 105, 97, and 11;

C.I. Solvent Red 135, 81, 18, 25, 19, 23, 24, 143, 146, and 182;

C.I. Solvent Violet 13;

C.I. Solvent Black 3;

C.I. Solvent Yellow 93; and

C.I. Solvent Green 3.

Further examples of sublimable or diffusible dyes that can be used include anthraquinone dyes, such as Sumikalon Violet RS™ (product of Sumitomo Chemical Co., Ltd.), Dianix Fast Violet 3R-FS™ (product of Mitsubishi Chemical Corporation.), and Kayalon Polyol Brilliant Blue N-BGM™ and KST Black 146™ (products of Nippon Kayaku Co., Ltd.); azo dyes such as Kayalon Polyol Brilliant Blue BM™, Kayalon Polyol Dark Blue 2BM™, and KST Black KR™ (products of Nippon Kayaku Co., Ltd.), Sumickaron Diazo Black 5G™ (product of Sumitomo Chemical Co., Ltd.), and Miktazol Black 5GH™ (product of Mitsui Toatsu Chemicals, Inc.); direct dyes such as Direct Dark Green B™ (product of Mitsubishi Chemical Corporation) and Direct Brown M™ and Direct Fast Black D™ (products of Nippon Kayaku Co. Ltd.); acid dyes such as Kayanol Milling Cyanine 5R™ (product of Nippon Kayaku Co. Ltd.); and basic dyes such as Sumicacryl Blue 6G™ (product of Sumitomo Chemical Co., Ltd.), and Aizen Malachite Green™ (product of Hodogaya Chemical Co., Ltd.); magenta dyes of the structures

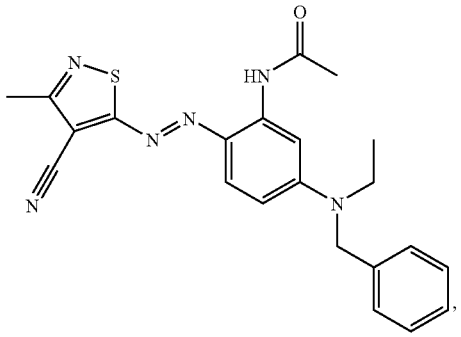

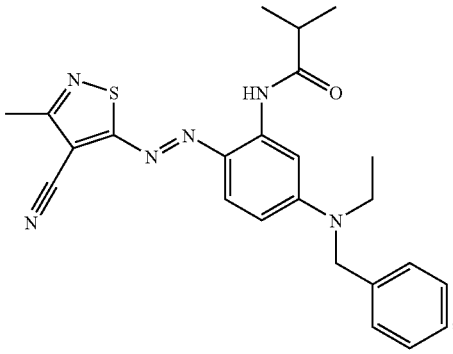

, and

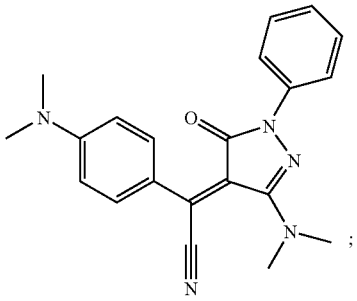

;

-continued cyan dyes of the structures

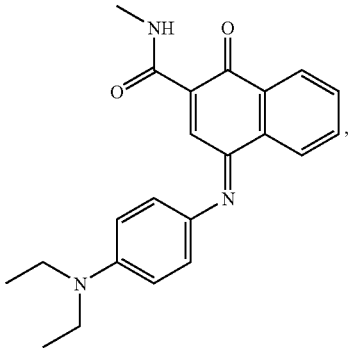

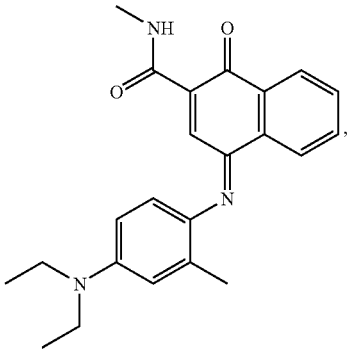

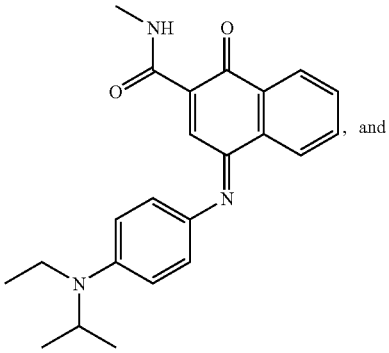

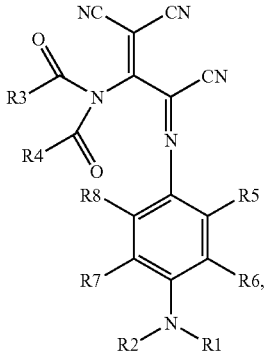

where R1 and R2 each independently represents an alkyl group, a cycloalkyl group, an aryl group, a heterocyclic group, or R1 and R2 together represent the necessary atoms to close a heterocyclic ring, or R1 and/or R2 together with R6 and/or R7 represent the necessary atoms to close a heterocyclic ring fused on the benzene ring; R3 and R4 each independently represents an alkyl group, or an alkoxy group; R5, R6, R7 and R8 each independently represents hydrogen, an alkyl group, a cycloalkyl group, an aryl group, an alkoxy group, an aryloxy group, a carbonamido group, a sulfamido group, hydroxy, halogen, $NHSO_2R_9$, $NHCOR_9$, $OSO_2R_9$, or $OCOR_9$, or R5 and R6 together and/or R7 and R8 together represent the necessary atoms to close one or more heterocyclic ring fused on the benzene ring, or R6 and/or R7 together with R1 and/or R2 represent the necessary atoms to close a heterocyclic ring fused on the benzene ring; and R9 represents an alkyl group, a cycloalkyl group, an aryl group and a heterocyclic group; and yellow dyes of the structures

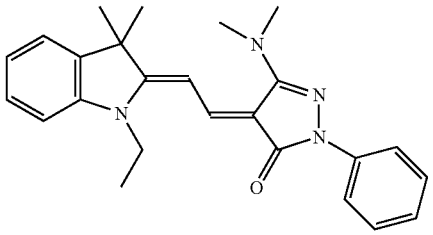

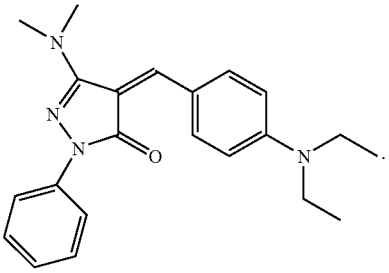

Further examples of useful dyes can be found in U.S. Pat. Nos. 4,541,830; 4,824,437; 4,910,187; 4,923,846; 5,026,677; 5,101,035; 5,142,089; 5,476,943; 5,804,531; and 6,265,345, and U.S. Patent Application Publication No. US 20030181331. Suitable cyan dyes can include Kayaset Blue 714 (Solvent Blue 63, manufactured by Nippon Kayaku Co., Ltd.), Phorone Brilliant Blue S-R (Disperse Blue 354, manufactured by Sandoz K.K.), and Waxoline AP-FW (Solvent Blue 36, manufactured by ICI). Suitable magenta dyes can include MS Red G (Disperse Red 60, manufactured by Mitsui Toatsu Chemicals, Inc.), and Macrolex Violet R (Disperse Violet 26, manufactured by Bayer). Suitable yellow dyes can include Phorone Brilliant Yellow S-6 GL (Disperse Yellow 231, manufactured by Sandoz K.K.) and Macrolex Yellow 6G (Disperse Yellow 201, manufactured by Bayer). The dyes can be employed singly or in combination to obtain a monochrome dye-donor layer or a black dye-donor layer. The dyes can be used in an amount of from 0.05 $gm^{-2}$ to 1 $gm^{-2}$ of coverage. According to various embodiments, the dyes can be hydrophobic.

Each dye-donor layer color patch can range from 20 wt. % to 90 wt. % dye, relative to the total dry weight of all components in the layer. A high amount of dye is desirable for increased efficiency, but higher amounts of dye can lead to increased occurrences of dye-donor/receiver sticking. Depending on the efficiency of dye transfer of a dye-donor layer, a lower amount of dye can be used to achieve the same efficiency as in a different colored dye-donor layer or patch. The dye percent is ideally chosen in view of the specific dye-donor and receiver combination. Varying the amount of dye in the dye-donor layer can aid in matching the efficiency between different dye patches, for example, a cyan, magenta, and yellow patch. For example, yellow and/or magenta patch dye amounts can be between 20 wt. % and 75 wt. % dye relative to the total dry weight of all components in the layer, for example, between 30 wt. % and 50 wt. %. A cyan patch dye amount can be between 40 wt. % and 90 wt. % dye relative to the total dry weight of all components in the layer, for example, between 55 wt. % and 75 wt. %.

To form a dye-donor layer, one or more dyes can be dispersed in a polymeric binder. One or more co-binders can be present. The binder can be used in an amount of from 0.05 $gm^{-2}$ to 5 $gm^{-2}$, for example, from 0.1 $gm^{-2}$ to 1.5 $gm^{-2}$. Suitable binders and co-binders can include, but are not limited to, cellulose derivatives, polyesters such as hydroxyalkanoic acid polyesters, polyvinylacetals, styrene-containing polymers, and acrylate-containing polymers. For example, suitable cellulose derivatives can include, but are not limited to, cellulose ester, cellulose ether, and cellulose nitrate polymers, for example, acetate hydrogen phthalate, cellulose acetate, cellulose acetate propionate, cellulose acetate butyrate, cellulose triacetate, cellulose nitrate, ethylcellulose, methylcellulose, and hydroxyalkyl celluloses such as hydroxypropyl cellulose, methylhydroxypropyl cellulose, and hydroxypropylmethyl cellulose. Suitable styrenic and acrylic co-binder polymers can include, but are not limited to, for example, poly(styrene-co-acrylonitrile), polystyrene, poly(methyl acrylate), poly(methyl methacrylate), poly(phenyl methacrylate), poly(butyl methacrylate), and poly(butyl acrylate). Suitable polyacetal polymers and copolymers can include, but are not limited to, for example, poly(vinylacetal), poly(vinylbutyral), poly(vinylpental), poly(vinylhexal), poly(vinylheptal), poly(vinylbutyral-co-vinylhexal), poly(vinylbutyral-co-vinylheptal), poly(vinylbutyral-co-vinyloctal), and poly(vinylbutyral-co-vinylnaphthal). Combinations of any one or more co-binder can be used. According to certain embodiments, the binder can include ethylcellulose. The ethylcellulose can have an ethoxyl content between 45 and 53%, preferably between 48 and 52%, and a solution viscosity of between 2 and 200 centipoise, for example, between 10 and 150 centipoise, as measured by a 5 wt. % solution in an 80/20 wt. % mixture of toluene and ethanol at 25° C. Mixtures of various ethylcellulose grades can be used.

The dye-donor layer of the dye-donor element can be formed or coated on a support. The dye-donor layer composition can be dissolved in a solvent for coating purposes. The dye-donor layer can be formed or coated on the support by techniques such as, but not limited to, a gravure process, spin-coating, solvent-coating, extrusion coating, or other methods known to practitioners in the art.

According to various embodiments, a subbing layer, for example, an adhesive or tie layer, a dye-barrier layer, or a combination thereof, can be coated between the support and the dye-donor layer. The subbing layer can be one or more layers. The adhesive or tie layer can adhere the dye-donor layer to the support. Suitable adhesives are known to practitioners in the art, for example, Tyzor TBT™ from E.I. DuPont de Nemours and Company. The dye-barrier layer can include a hydrophilic polymer. The dye-barrier layer can provide improved dye transfer densities.

The dye-donor element can include a stick preventative agent to reduce or eliminate sticking between the dye-donor element and the receiver element during printing. The stick preventative agent can be present in any layer of the dye-donor element, so long as the stick preventative agent is capable of diffusing through the layers of the dye-donor element to the dye-donor layer, or transferring from the substrate to the dye-donor layer, such as when the dye-donor element is stored in roll form such that the dye-donor layer is adjacent to and touches the substrate. For example, the stick preventative agent can be present in one or more patches of the dye-donor layer, in the substrate, in an adhesive layer, in a dye-barrier layer, or in a combination thereof. According to various embodiments, the stick preventative agent can be in the substrate, the dye-donor layer, or both. According to various embodiments, the stick preventative agent can be in the dye-donor layer. The stick preventative agent can be in one or more colored patches of the dye-donor layer, or a combination thereof. If more than one dye patch is present in the dye-donor layer, the stick preventative agent can be present in the last patch of the dye-donor layer to be printed, typically the cyan layer. However, the dye patches can be in any order. For example, if repeating patches of cyan, magenta, and yellow are used in the dye-donor element, in that respective order, the yellow patches, as the last patches printed in each series, can include the stick preventative agent. The stick preventative agent can be a silicone- or siloxane-containing polymer. Suitable polymers can include graft co-polymers, block polymers, copolymers, and polymer blends or mixtures. Suitable stick preventative agents are described, for example, in commonly assigned U.S. Application Publications US 2005-0059550 A1 to David G. Foster, et al., and US 2005-0059552 A1 to Teh-Ming Kung, et al.

Optionally, release agents as known to practitioners in the art can also be added to the dye-donor element, for example, to the dye-donor layer, the substrate, or both. Suitable release agents include, for example, those described in U.S. Pat. Nos. 4,740,496 and 5,763,358.

According to various embodiments, the dye-donor layer can contain no plasticizer. However, inclusion of a plasticizer in the dye-donor layer can increase dye-donor efficiency. Thus the dye-donor layer can include plasticizers known in the art, such as those described in U.S. Pat. Nos. 5,830,824 and 5,750,465, and references disclosed therein. Suitable plasticizers can be defined as compounds having a glass transition temperature (Tg) less than 25° C., a melting point ($T_m$) less than 25° C., or both. Plasticizers useful for this invention can include low molecular weight plasticizers and higher molecular weight plasticizers such as oligomeric or polymeric plasticizers.

The dye-donor layer can include beads. The beads can have a particle size of from 0.5 to 20 microns, preferably from 2.0 to 15 microns. The beads can act as spacer beads under the compression force of a wound up dye-donor roll, improving raw stock keeping of the dye-donor roll by reducing the material transferred from the dye-donor layer to the backside of the dye-donor element, for example, a slipping layer, or vice versa, as measured by the change in sensitometry under accelerated aging conditions, or the appearance of unwanted dye in the laminate layer. The use of the beads can result in reduced mottle and improved image quality. The beads can be employed in any amount effective for the intended purpose. In general, good results have been obtained at a coverage of from 0.003 to 0.20 $gm^{-2}$.

The beads in the dye-donor layer can be crosslinked, elastomeric beads. The beads can have a glass transition temperature (Tg) of 45° C. or less, for example, 10° C. or less. The elastomeric beads can be made from an acrylic polymer or copolymer, such as butyl-, ethyl-, propyl-, hexyl-, 2-ethyl hexyl-, 2-chloroethyl-, 4-chlorobutyl- or 2-ethoxyethyl-acrylate or methacrylate; acrylic acid; methacrylic acid; hydroxyethyl acrylate; a styrenic copolymer, such as styrene-butadiene, styrene-acrylonitrile-butadiene, styrene-isoprene, or hydrogenated styrene-butadiene; or mixtures thereof. The elastomeric beads can be crosslinked with various crosslinking agents, which can be part of the elastomeric copolymer, such as but not limited to divinylbenzene; ethylene glycol diacrylate; 1,4-cyclohexylene-bis(oxyethyl)dimethacrylate; 1,4-cyclohexylene-bis(oxypropyl)diacrylate; 1,4-cyclohexylene-bis(oxypropyl)dimethacrylate; and ethylene glycol dimethacrylate. The elastomeric beads can have from 1 to 40%, for example, from 5 to 40%, by weight of a crosslinking agent.

The beads in the dye-donor layer can be hard polymeric beads. Suitable beads can include divinylbenzene beads, beads of polystyrene crosslinked with at least 20 wt. % divinylbenzene, and beads of poly(methyl methacrylate) crosslinked with at least 20 wt. % divinylbenzene, ethylene glycol dimethacrylate, 1,4-cyclohexylene-bis(oxyethyl)dimethacrylate, 1,4-cyclohexylene-bis(oxypropyl)dimethacrylate, or other crosslinking monomers.

The dye-donor element can be a sheet of one or more colored patches or laminate, or a continuous roll or ribbon. The continuous roll or ribbon can include one patch of a monochromatic color or laminate, or can have alternating areas of different patches, for example, one or more dye patches of, for example, cyan, magenta, yellow, or black, one or more laminate patches, or a combination thereof.

The receiver element suitable for use with the dye-donor element described herein can be any receiver element as known to practitioners in the art. For example, the receiver element can include a support having thereon a dye image-receiving layer. The support can be a transparent film. Transparent supports can include cellulose derivatives, for example, a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; poly(vinylalcohol-co-vinylacetal); polyolefins, such as polyethylene or polypropylene; polysulfones; polyacrylates; polyetherimides; and mixtures thereof. Opaque supports can include plain paper, coated paper, synthetic paper, photographic paper support, melt-extrusion-coated paper, and laminated paper, such as biaxially oriented support laminates. Biaxially oriented support laminates suitable for use as receivers can include those described in U.S. Pat. Nos. 5,853,965; 5,866,282; 5,874,205; 5,888,643; 5,888,681; 5,888,683; and 5,888,714. Biaxially oriented supports can include a paper base and a biaxially oriented polyolefin sheet, for example, polypropylene, laminated to one or both sides of a paper base. The support can be a reflective paper, for example, baryta-coated paper, white polyester (polyester with white pigment incorporated therein), an ivory paper, a condenser paper, or a synthetic paper, for example, DuPont Tyvek™ by E.I. DuPont de Nemours and Company, Wilmington, Del. The support can be employed at any desired thickness, for example, from 10 μm to 1000 μm. Exemplary supports for the dye image-receiving layer are disclosed in commonly assigned U.S. Pat. Nos. 5,244,861 and 5,928,990, and in EP-A-0671281. Other suitable supports as known to practitioners in the art can also be used. According to various embodiments, the support can be a composite or laminate structure comprising a base layer and one or more additional layers. The base layer can comprise more than one material, for example, a combination of one or more of a microvoided layer, a nonvoided layer, a synthetic paper, a natural paper, and a polymer.

The dye image-receiving layer of the receiver element can be, for example, a polycarbonate; a polyurethane; a polyester; poly(vinyl chloride); poly(styrene-co-acrylonitrile); poly(caprolactone); poly(vinylacetal)s, for example, poly(vinylbutyral) and polyvinylheptal; poly(vinyl chloride-co-vinyl acetate); poly(ethylene-co-vinyl acetate); methacrylates, including those described in U.S. Pat. No. 6,362,131; or combinations thereof. The dye image-receiving layer can be coated on the receiver element support in any amount effective for the intended purpose of receiving the dye from the dye-donor layer of the dye-donor element. For example, the dye image-receiving layer can be coated in an amount of from 1 $gm^{-2}$ to 5 $gm^{-2}$.

Additional polymeric layers can be present between the support and the dye image-receiving layer. The additional layers can provide coloring, adhesion, antistat properties, act as a dye-barrier, act as a dye mordant layer, or a combination thereof. For example, a polyolefin such as polyethylene or polypropylene can be present. White pigments such as titanium dioxide, zinc oxide, and the like can be added to the polymeric layer to provide reflectivity. A subbing layer optionally can be used over the polymeric layer in order to improve adhesion to the dye image-receiving layer. This can be called an adhesive or tie layer. Exemplary subbing layers are disclosed in U.S. Pat. Nos. 4,748,150, 4,965,238, 4,965,239, and 4,965,241. An antistatic layer as known to practitioners in the art can also be used in the receiver element. The receiver element can also include a backing layer. Suitable examples of backing layers include those disclosed in U.S. Pat. Nos. 5,011,814 and 5,096,875.

The dye image-receiving layer, or an overcoat layer thereon, can contain a release agent, for example, a silicone or fluorine based compound, as is conventional in the art. Various exemplary release agents are disclosed, for example, in U.S. Pat. Nos. 4,820,687 and 4,695,286.

The receiver element can also include stick preventative agents, as described for the dye-donor element. According to various embodiments, the receiver element and dye-donor element can include the same stick preventative agent.

The dye image-receiving layer can be formed on the support by any method known to practitioners in the art, including but not limited to printing, solution coating, dip coating, and extrusion coating. Wherein the dye image-receiving layer is extruded, the process can include (a) forming a melt comprising a thermoplastic material; (b) extruding or coextruding the melt as a single-layer film or a layer of a composite (multilayer or laminate) film; and (c) applying the extruded film to the support for the receiver element.

The dye-donor element and receiver element, when placed in superposed relationship such that the dye-donor layer of the dye-donor element is adjacent the dye image-receiving layer of the receiver element, can form a print assembly. An image can be formed by passing the print assembly past a print head, wherein the print head is located on the side of the dye-donor element opposite the receiver element. The print head can apply heat image-wise or patch-wise to the dye-donor element, causing the dyes or laminate in the dye-donor layer to transfer to the dye image-receiving layer of the receiver element.

Thermal print heads that can be used with the print assembly are available commercially and known to practitioners in the art. Exemplary thermal print heads can include, but are not limited to, a Fujitsu Thermal Head (FTP-040 MCSOO1), a TDK Thermal Head F415 HH7-1089, a Rohm Thermal Head KE 2008-F3, a Shinko head (TH300U162P-001), and Toshiba heads (TPH162R1 and TPH207R1A).

Use of the dye-donor element as described herein can enable high-speed printing of the print assembly, wherein high speed printing refers to printing at a line speed of 2.0 msec per line or less, for example, 1.5 msec per line or less, 1.2 msec per line or less, 1.0 msec per line or less, or 0.5 msec per line or less.

The use of the dye-donor element as described herein wherein the substrate is extruded and includes a slip agent in one or more layers enables more efficient thermal transfer through the donor element and reduces cost by eliminating unnecessary layers, such as a separate slip layer. The substrate including the slip agent maintains good dye-donor layer keeping properties, increases dye transfer efficiency, and prevents sticking of the dye-donor material to the print head during the printing process. The substrate provides necessary dimensional stability for the dye-donor element while also providing necessary lubrication to facilitate transport through the printing mechanism.

Examples are herein provided to further illustrate the invention.

EXAMPLE

Materials used in the example that follows include the following: polyethylene terephthalate (PET 7352) pellets from Eastman Chemical Company, Kingsport, Tenn.; MB50-10 ultra high molecular weight siloxane polymer dispersed in a thermoplastic polyester elastomer from Dow Coming, Midland, Mich.; Ceramer™ 1608 low molecular weight olefin/maleic polymer, Vybar™ 103 low molecular weight polyalphaolefin, and Unilin™ 350 hydroxyl terminated polyethylene from Baker-Petrolite, Sugar Land, Tex.; Synfluo 178XF including a combination of micronized synthetic wax and PTFE, and Superslip 6515XF combination of wax polymers from Micro Powders, Inc., Tarrytown, N.Y.; Glycolube P(ETS) pentaerthyritol tetrastearate, and Acrawax C N,N' ethylene bistearamide wax from Lonza Inc, Fair Lawn, N.J.; and Acumist 3205 and Acumist 3305 PTFE micronized wax blend with polyethylene wax from Honeywell Specialty Chemicals, Seelze, Germany.

In order to facilitate extrusion of slip layers with varying slip agent concentrations, master batches of the slip agents in the Table below were made in a Leistritz Micro 27 twin screw compounder. Other suitable twin screw compounders are made by Werner Pfleiderrer and Berstorff.

All the master batches were produced in a polyester (PET 7352) resin that has an intrinsic viscosity of 0.70 dl/g. The PET resin was dried overnight at 149° C. prior to being used in the compounder. Slip agents were dried prior to use as needed. In preparation of the film samples, the masterbatches were dried overnight at 80° C., while the polyester resin not containing the slip additives (base resin) was dried overnight at 149° C. Let downs leading to various concentrations of the slip agent were made by physical blending of a master batch with the polyester resin. The substrate comprising PET and the slip agent was coextruded with a carrier layer of polypropylene. The extrusion setup contained two extruders to form a two-layered melt stream (slip agent mixture and substrate) that was rapidly quenched on a chill roll after issuing from the die. After extrusion, the substrate was separated from the carrier layer by peeling. The substrate was stretched in the machine direction by 3.2 times at a temperature of about 94° C., and then stretched in the transverse direction by 3.2 times at a temperature of about 94° C. These samples are referred to as "extruded and stretched," and the final substrate thickness was 4 μm.

The above described donor element was placed in contact with a dye-receiving element of the same area. This assembly was clamped to a stepper motor driving a 60 mm diameter rubber roller. A TDK Model L-231 thermal head, thermostatted at 28° C., was pressed against the donor substrate of the assembly with a force of 24.75 Newton (5.5 lbs).

The imaging electronics were activated causing the donor/receiver assemblage to be drawn between the print head and roller. At the same time the resistive elements in the thermal print head were pulsed for 128 microsec/pulse at 134 microsecond intervals during a 4.575 millisec/dot printing time. A stepped density image was generated by incrementally increasing the number of pulses/dot from 0 to 32 (D-min to D-max). The voltage supplied to the print head was approximately 13 volts, resulting in a maximum total energy of approximately 1.45 mJ/dot.

The test pattern consisted of a series of wide bars followed by a series of narrower bars. In particular, a first wide bar at high density, to warm up the print head, was followed by a second wide bar at low density D-max, followed by a third wide bar at high density. This was followed by a wide bar at D-min and then a series of thinner alternating high density and zero density bars having no dye.

As each area test pattern of given density was being generated, the torque required to draw the assemblage through the print nip was measured with a Himmelstein Corp. Model 3-308TL (16-1) Torquemeter (1.09 meter-Newton range) and Model 6,201 Conditioning Module.

Of particular importance in these experiments was whether or not the materials stuck to the print head during the printing process. If materials stuck to the print head, it was a clear indication that there was not sufficient slipping agent in the substrate. If the materials were successfully transported through the printer, there was a sufficient amount of slipping agent in the substrate.

The Table below shows the friction gauge testing results for various polymer combinations. A "yes" in the right hand column indicates that the material passed through the printer test mechanism successfully and that a sufficient amount of slip agent was incorporated. A "no" indicates complete printing failure, wherein the material annealed to the print head mechanism during the printing process because it did not contain a sufficient amount of slip agent.

| Identification | Substrate | Successful Printing |
|---|---|---|
| C-1 | PET without Slipping Agent | No |
| I-1 | PET with MB50-10 @ 10% | Yes |
| I-2 | PET with MB50-10 @ 4% | Yes |
| C-2 | PET with MB50-10 @ 3% | No |
| C-3 | PET with MB50-10 @ 2% | No |
| C-4 | PET with MB50-10 @ 1% | No |
| I-3* | PET with MB50-10 @ 0.67% + (Vybar ™ 103 + Ceramer ™ 1608 + Unilin ™ 350) @ 1.11% | Yes |
| I-4* | PET with MB50-10 @ 0.5% + (Vybar ™ 103 + Ceramer ™ 1608 + Unilin ™ 350) @ 0.83% | Yes |
| I-5* | PET with MB50-10 @ 0.55% + (Vybar ™ 103 + Ceramer ™ 1608 + Unilin ™ 350) @ 2% | Yes |
| I-6* | PET with Vybar ™ 103 + Ceramer ™ 1608 + Unilin ™ 350 @ 1% | Yes |
| C-5 | PET with Acrawax C @ 2% | No |
| C-6 | PET with Acrawax C @ 1% | No |
| C-7 | PET with Glycolube P(ETS) @ 1% | No |
| C-8 | PET with Glycolube P(ETS) @ 2% | No |
| C-9 | PET with Superslip 6515XF @ 2% | No |
| C-10 | PET with Superslip 6515XF @ 1% | No |
| C-11 | PET with Synfluo 178XF @ 2% | No |
| C-12 | PET with Acumist 3305 @ 2% | No |

-continued

| Identification | Substrate | Successful Printing |
|---|---|---|
| C-13 | PET with Acumist 3305 @ 3% | No |
| I-7 | PET with Acumist 3205 @ 1% | Yes |

*Vybar 103, Ceramer 1608, and Polywax 400 were mixed in equal proportions to achieve the stated amount.

As can be seen from the table, use of a high molecular weight silicone resin (MB50-10) alone can work as a slip agent if sufficient amounts are used (4% or more). However, combining the silicone resin with one or more low molecular weight polyolefin wax lowers the total amount of slip agent required, thereby lowering material costs.

The invention has been described in detail with particular reference to certain preferred embodiments thereof, but it will be understood that variations and modifications can be effected within the spirit and scope of the invention.

The invention claimed is:

1. A thermal donor element comprising:

a substrate comprising two or more co-extruded layers, one co-extruded layer containing a polyester-containing material and another co-extruded layer containing a slip agent; and a dye layer on one side of the co-extruded substrate, wherein the co-extruded substrate does not contain silica particles.

2. The thermal donor of claim 1, wherein the slip agent comprises a mixture of low-molecular weight polyolefin waxes.

3. The thermal donor of claim 1, wherein the slip agent comprises a mixture of a low-molecular weight polyolefin wax and a high-molecular weight silicone resin.

4. The thermal donor of claim 3, wherein the wax has viscosity of less than 1000 cSt.

5. The thermal donor of claim 3, wherein the silicone resin has a viscosity greater than a million cSt.

6. The thermal donor of claim 1, wherein the slip agent comprises a siloxane resin or copolymer thereof, a polyethylene wax, a polyalphaolefin wax, or a combination thereof.

7. The thermal donor of claim 1, wherein the slip agent is in a polymeric matrix.

8. The thermal donor of claim 1, wherein the polyester-containing material is polyethylene terephthalate, polyethylene naphthalate, polylactic acid, or a combination thereof.

9. The thermal donor of claim 1, further comprising an adhesive layer between the co-extruded substrate and the dye layer.

10. The thermal donor of claim 1, wherein the slip agent is present in the co-extruded substrate in an amount of from 0.5 weight % to 5.0 weight %.

11. A print assembly comprising the thermal donor element of claim 1, and a receiver.

12. A method of forming a thermal donor element, comprising:

obtaining an extrudable composition comprising a polyester-containing material and a second extrudable composition comprising a slip agent, wherein the extrudable compositions do not comprise silica;

co-extruding the compositions to form a co-extruded substrate having two or more co-extruded layers; and forming a dye-layer on the co-extruded substrate.

13. The method of claim 12, wherein forming the dye-layer comprises solvent coating the dye layer.

14. The method of claim 12, wherein the extrudable composition containing the slip agent comprises a polymeric matrix.

15. The method of claim 12, wherein the co-extruded compositions are co-extruded at a temperature of at least about 200° C.

16. A method of printing comprising:

obtaining a thermal donor element comprising co-extruded substrate having two or more co-extruded layers, one co-extrudable layer including a polyethylene-containing material and a slip agent, and a dye layer on the co-extruded substrate, wherein the co-extruded substrate does not comprise silica;

obtaining a receiver having a receiving layer;

superposing the dye layer and the receiving layer; and applying thermal energy to the co-extruded substrate of the donor element.

17. The method of claim 12 wherein said dye-layer is formed on the co-extruded substrate by spray coating.

18. A method of forming a thermal donor element, comprising:

obtaining an extrudable composition comprising a polyester-containing material and a second extrudable composition comprising a slip agent, wherein the extrudable compositions do not comprise silica;

co-extruding compositions to form a co-extruded substrate having two or more co-extruded layers; and forming a thermally transferable protective laminate layer on the co-extruded substrate.

19. The method of claim 18 wherein said protective laminate layer is formed by solvent coating.

20. The method of claim 18 wherein said protective laminate layer is formed by spray coating.

* * * * *